US011241037B2

(12) United States Patent
Sweedler

(10) Patent No.: US 11,241,037 B2
(45) Date of Patent: Feb. 8, 2022

(54) DUAL CARTRIDGE VAPORIZATION DEVICE AND SUBSTANCE CARTRIDGE FOR USE THEREWITH

(71) Applicant: Windsong Brands, Westport, CT (US)

(72) Inventor: Zachary Ryan Sweedler, Westport, CT (US)

(73) Assignee: WINDSONG BRANDS, Westport, CT (US)

( * ) Notice: Subject to any disclaimer, the term of this patent is extended or adjusted under 35 U.S.C. 154(b) by 0 days.

(21) Appl. No.: 17/336,718

(22) Filed: Jun. 2, 2021

(65) Prior Publication Data

US 2021/0368863 A1 Dec. 2, 2021

Related U.S. Application Data

(60) Provisional application No. 63/033,659, filed on Jun. 2, 2020.

(51) Int. Cl.

| | |
|---|---|
| ***A24F 13/00*** | (2006.01) |
| ***A24F 40/30*** | (2020.01) |
| ***H05B 1/02*** | (2006.01) |
| ***A24F 40/10*** | (2020.01) |
| ***A24F 40/485*** | (2020.01) |
| ***A24F 40/57*** | (2020.01) |
| ***A24F 40/42*** | (2020.01) |

(52) U.S. Cl.

CPC ..... *A24F 40/30* (2020.01); *A24F 40/10* (2020.01); *A24F 40/42* (2020.01); *A24F 40/485* (2020.01); *A24F 40/57* (2020.01); *H05B 1/0297* (2013.01)

(58) Field of Classification Search

CPC ..... A24F 47/00

USPC ..... 131/328–329

See application file for complete search history.

(56) References Cited

U.S. PATENT DOCUMENTS

| | | | |
|---|---|---|---|
| 5,285,798 | A | 2/1994 | Banerjee et al. |
| 5,388,594 | A | 4/1995 | Counts et al. |
| 10,111,470 | B2 | 10/2018 | Monsees et al. |
| 10,653,180 | B2 | 5/2020 | Monsees et al. |
| 2011/0265806 | A1 | 11/2011 | Alarcon et al. |
| 2018/0056015 | A1 | 3/2018 | Shwadchuck |
| 2019/0082740 | A1 | 3/2019 | Verleur et al. |
| 2019/0116886 | A1 | 4/2019 | Rostami et al. |
| 2019/0314585 | A1 | 10/2019 | Rostami et al. |
| 2019/0320716 | A1* | 10/2019 | Seidenfeld ..... A24F 40/90 |

(Continued)

FOREIGN PATENT DOCUMENTS

| | | |
|---|---|---|
| CN | 203505587 U | 4/2014 |
| CN | 105167199 B | 4/2018 |

(Continued)

OTHER PUBLICATIONS

PCT International Search Report and Written Opinion of the International Searching Authority for International Application PCT/US21/35394, dated Sep. 10, 2021.

*Primary Examiner* — Phuong K Dinh

(74) *Attorney, Agent, or Firm* — Flener IP & Business Law; Zareefa B. Flener; Ayhan E. Mertogul

(57) ABSTRACT

A vaporization device comprises one or more batteries disposed in a body portion having a first longitudinal center plane and two or more identical substance cartridges each adapted to detachably attach to the body portion in first and second orientations relative to the first longitudinal center plane.

19 Claims, 9 Drawing Sheets

(56) References Cited

U.S. PATENT DOCUMENTS

| | | | | |
|---|---|---|---|---|
| 2019/0357596 | A1 | 11/2019 | Blick et al. | |
| 2021/0022396 | A1* | 1/2021 | Lee | A24F 40/42 |
| 2021/0227881 | A1* | 7/2021 | Bessant | A24F 40/46 |

FOREIGN PATENT DOCUMENTS

| | | | |
|---|---|---|---|
| CN | 208002111 | U | 10/2018 |
| CN | 209594749 | U | 11/2019 |
| CN | 210017905 | U | 2/2020 |
| CN | 210184520 | U | 3/2020 |
| CN | 210184534 | U | 3/2020 |
| CN | 210445673 | U | 5/2020 |
| CN | 211129729 | U | 7/2020 |
| CN | 211558803 | U | 9/2020 |
| CN | 212368330 | U | 1/2021 |
| CN | 212437303 | U | 2/2021 |
| JP | 2001209438 | A | 8/2001 |
| WO | 2017167511 | A1 | 5/2017 |
| WO | 2020005695 | A1 | 1/2020 |
| WO | 2020097737 | A1 | 5/2020 |

* cited by examiner

DUAL CARTRIDGE VAPORIZATION DEVICE AND SUBSTANCE CARTRIDGE FOR USE THEREWITH

CROSS-REFERENCE TO RELATED APPLICATIONS

This application claims the benefit of priority to U.S. Provisional Patent Application No. 63/033,659 filed on Jun. 2, 2020 and incorporated in its entirety by reference herein.

FIELD OF THE INVENTION

The present invention relates to a dual cartridge vaporization device. More specifically the present invention relates to a dual cartridge vaporization device having two or more identical substance cartridges each adapted to detachably attach to a body portion in multiple orientations.

BACKGROUND OF THE INVENTION

Vaporization devices currently available on the market provide for a single disposable substance cartridge or pod that detachably attaches to a body portion. The single disposable cartridge or pod comprises a neat solution of cannabinoid, tetrahydrocannabinol, caffeine, nicotine or flavoring or mixtures thereof. However, there is a need for a device that allows a user to choose to vaporize two or more substances delivered simultaneously from two or more separate disposable substance cartridges/pods. It would be beneficial if the two or more cartridges/pods could attach to the body portion in different configurations that allow the user to draw vapor from only one or from both of the cartridges/pods. It would be further beneficial for the vaporization device to include multiple voltage settings for powering the heating elements, thereby providing additional choices for enjoyment of the vaporized substances.

SUMMARY OF THE INVENTION

In one aspect of the invention, a vaporization device comprises one or more batteries disposed in a body portion having a first longitudinal center plane and two or more identical substance cartridges each adapted to detachably attach to the body portion in first and second orientations relative to the first longitudinal center plane.

In another aspect of the invention, a vaporization device comprises one or more batteries disposed in a body portion, two or more identical substance cartridges each adapted to detachably attach to the body portion, and a voltage regulator electrically connected between the one or more batteries and each of the two or more identical substance cartridges, wherein the voltage regulators are configured to output at least two distinct voltages.

In a further aspect of the invention, a substance cartridge for a vaporization device comprises a housing having first and second longitudinal ends, a longitudinal center plane that extends between the first and second longitudinal ends, and a first mating surface at the first longitudinal end. The substance cartridge further comprises a vapor outlet hole disposed through a second surface at the second longitudinal end, wherein the vapor outlet hole is laterally offset from the longitudinal center plane.

DETAILED DESCRIPTION OF THE INVENTION

The following detailed embodiments presented herein are for illustrative purposes. That is, these detailed embodiments are intended to be exemplary of the present invention for the purposes of providing and aiding a person skilled in the pertinent art to readily understand how to make and use of the present invention.

Operation of a vaporization device having a single substance cartridge/pod is known in the art as, for example, disclosed by U.S. Ser. No. 10/111,470, which is incorporated herein in its entirety by reference. However, as noted hereinabove there are many areas of known vaporization devices that can be improved, for example without limitation for the enjoyment of the user, and for the convenience of use of the vaporization device.

Figure 1:
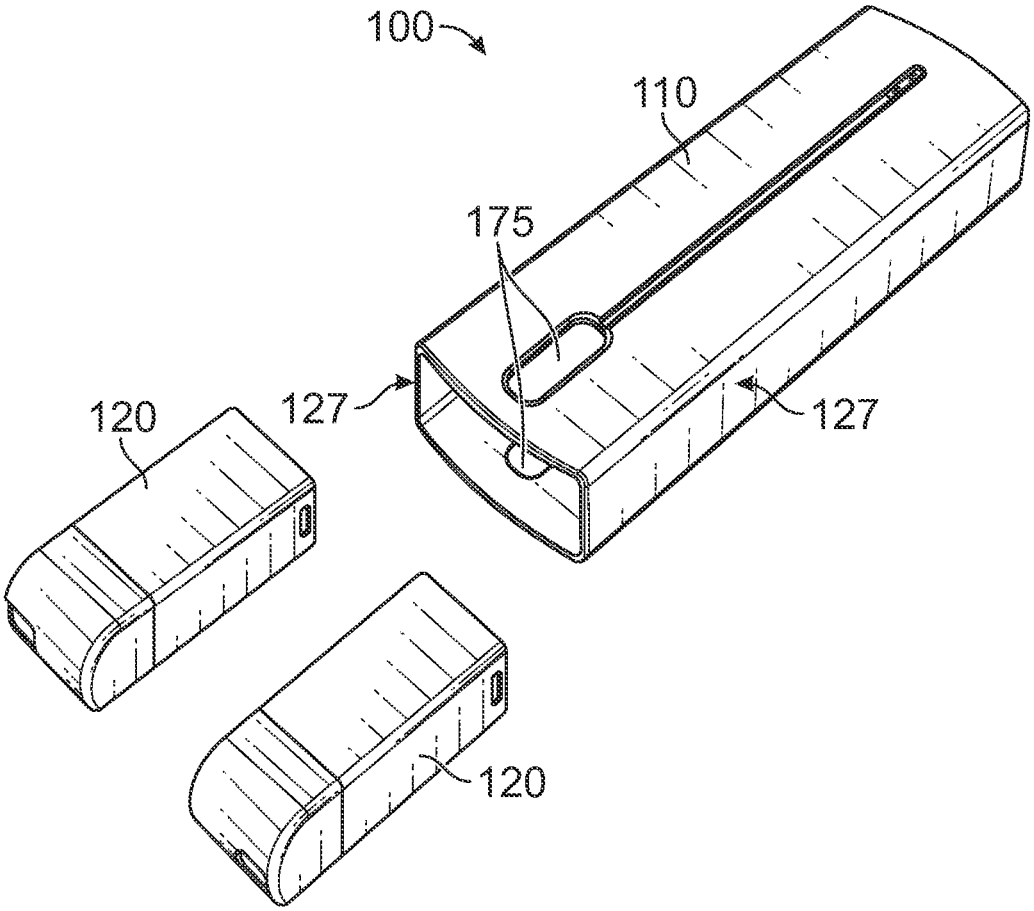
FIG. 1 shows an exploded perspective view of an exemplary embodiment of a dual cartridge vaporization device.

FIG. 1 shows an exploded view of an embodiment of a vaporization device 100 comprising a body portion 110 that houses one or more batteries 152 (shown schematically in FIG. 11) therein, and two or more detachably attached identical substance cartridges/pods 120. The one or more batteries 152 may be individual single use or rechargeable batteries or may be part of a single use or rechargeable battery pack as is known in the art. In an embodiment the two or more detachably attached identical substance cartridges/pods 120 are disposable.

Figure 2A:
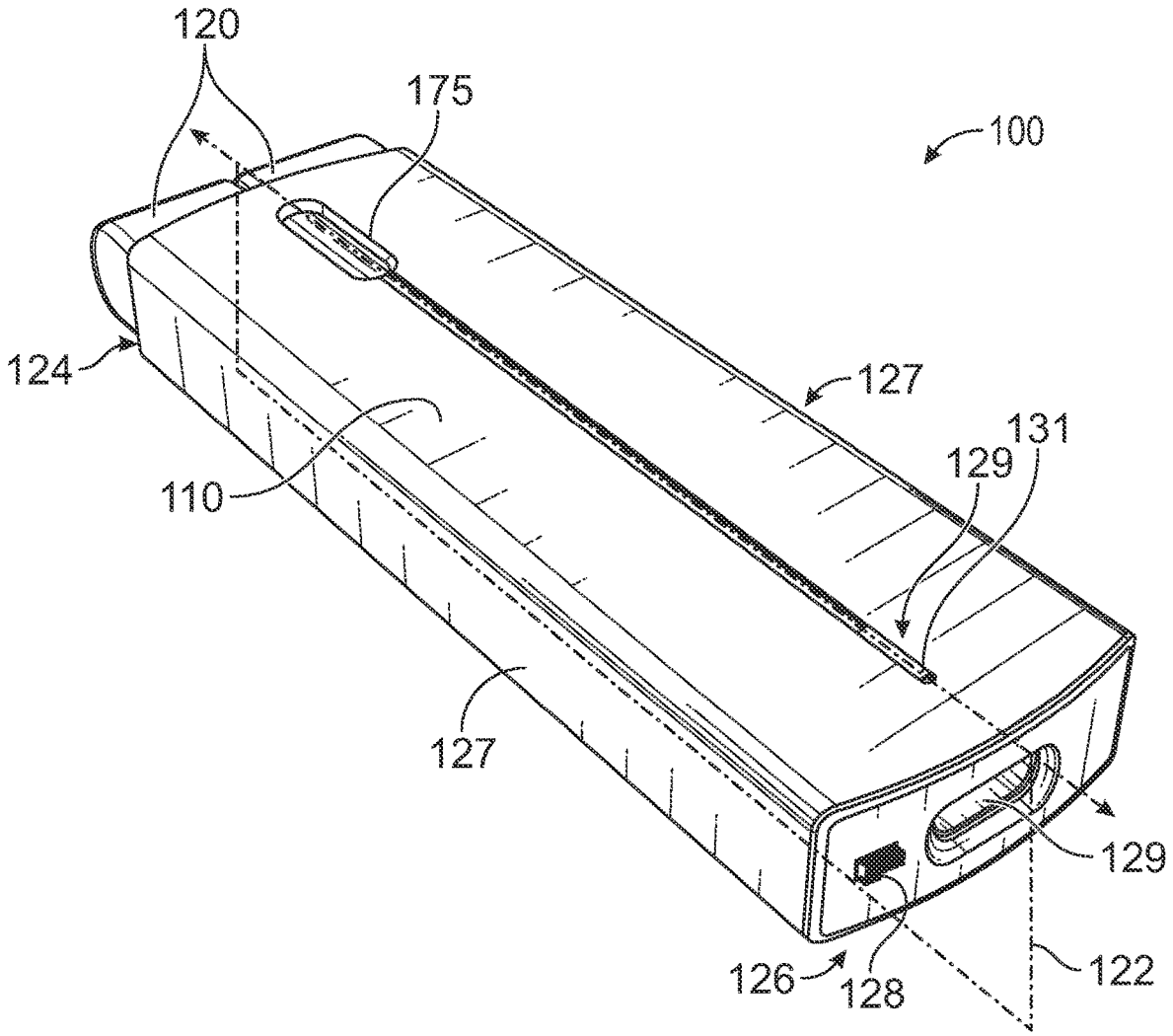
FIG. 2A shows a back perspective view of an exemplary embodiment of a dual cartridge vaporization device in an assembled state.

Referring to FIG. 2A, the vaporization device 100 is shown in an assembled state wherein the cartridges/pods 120 have been attached into a first end 124 of the body portion 110. The body portion 110 includes a first longitudinal center plane 122 (see also FIGS. 5 and 6) that is centered between lateral sides 127 of the body portion 110. The first longitudinal center plane 122 passes longitudinally through a center of the body portion 110 between the cartridges/pods 120 when assembled into the body portion 110 as shown in FIG. 2A. In an embodiment, a surface of the body portion 110 includes a window 129 that houses an indicator light 131 that illuminates when a user draws on one or both of the cartridges/pods 120.

Figure 2B:
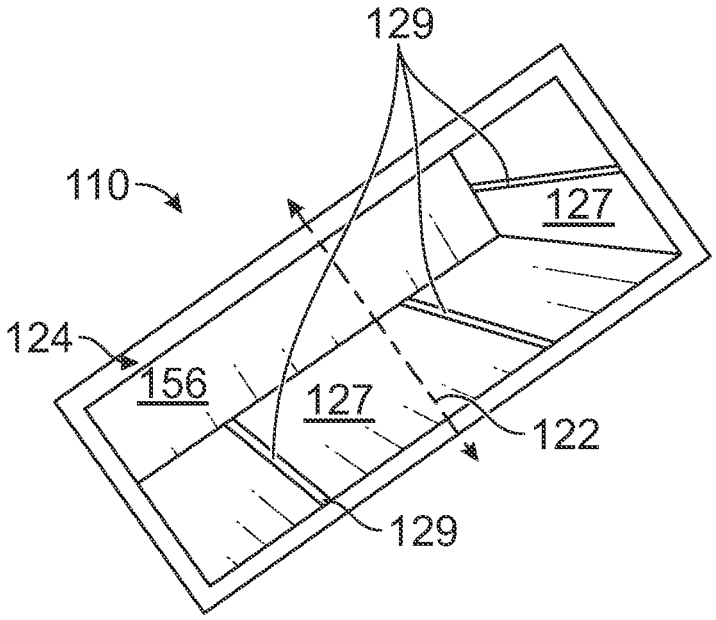
FIG. 2B shows a front perspective view looking into an exemplary body portion.
Figure 3:
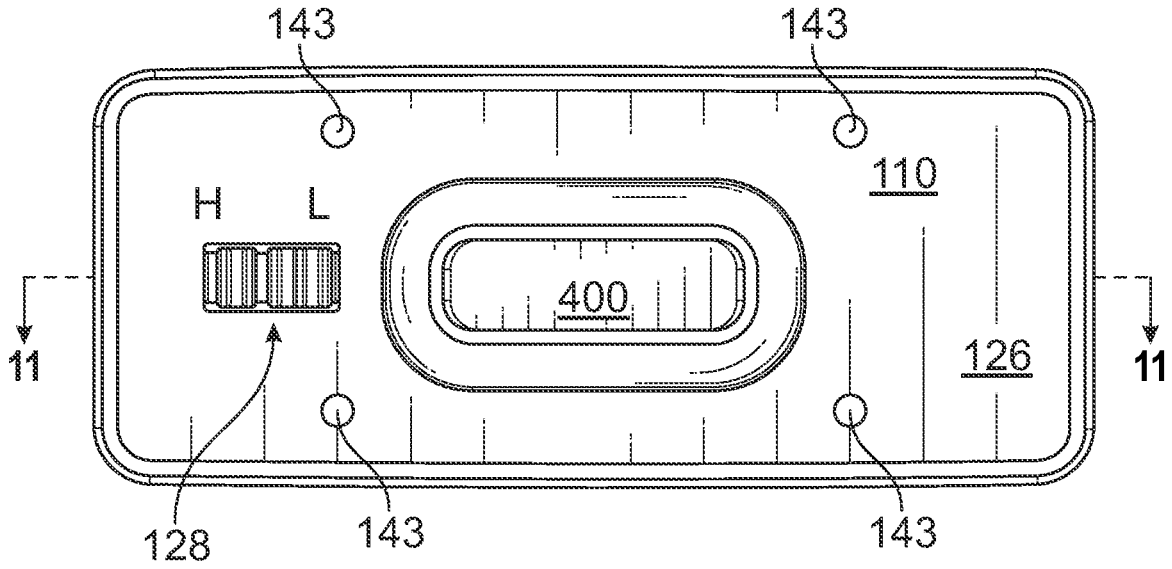
FIG. 3 shows features on an end of a body portion of an exemplary embodiment of a dual cartridge vaporization device.

Referring to FIGS. 2 and 3, a second end 126 of the body portion 110 opposite the first end 124 includes a switch 128. In an embodiment the switch 128 has at least first and second configurations; however, in other embodiments the switch 128 has three, four, five, or more configurations. The two, three, four, five or more configurations of the switch 128 can be a physical manifestation of the structure of the switch 128, for example a physical orientation of a structural element of the switch 128 that changes the position of internal electrical contacts. Alternatively, the two, three, four, five or more configurations of the switch 128 can be a manifestation of electronic switching occurring on internal control circuitry 340 (see below) that is externally controlled by another process or device. For example, in an embodiment the switch 128 has two, three, four, five, or more configurations that are electronically selected via a software application running on a computer or phone that communicates wirelessly with the switch 128 or the internal control circuitry 340.

Figure 13:
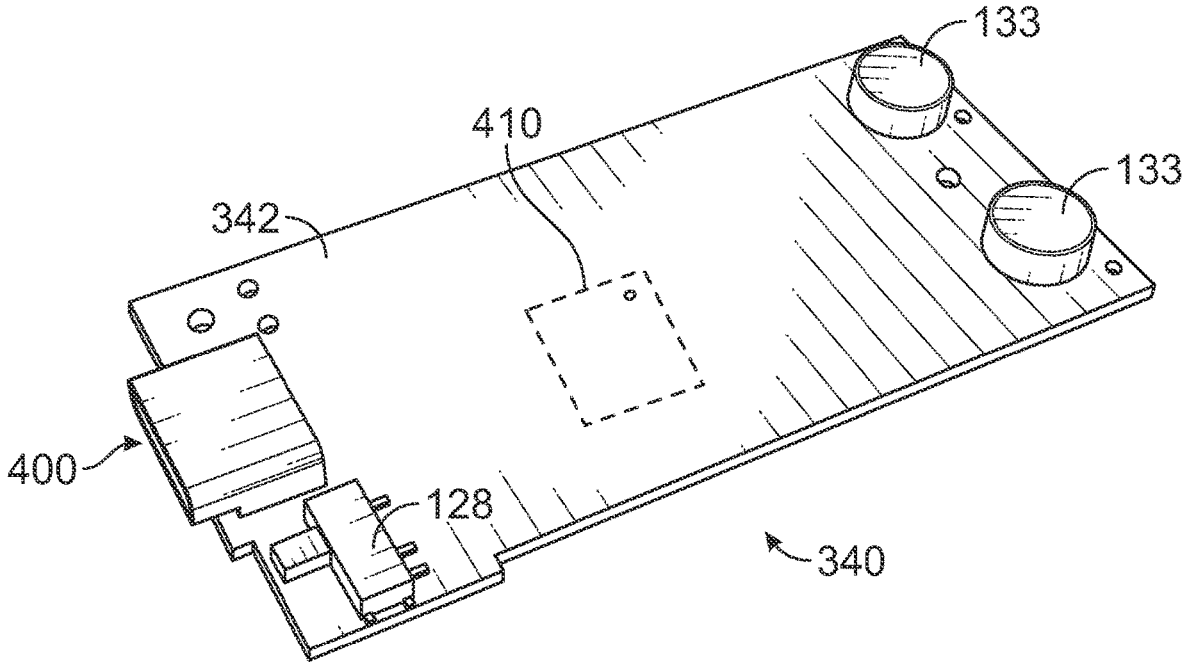
FIG. 13 shows a schematic representation of an exemplary embodiment of internal control circuitry including some individual components of the circuitry.

Referring to FIG. 13, in an embodiment, the switch 128 comprises a two-position slide switch having a protruding slide portion that can be in one of two positions. Referring to FIG. 3, for example, the two positions for the protruding slide portion of the switch 128 can labeled as H and L, which without limitation in this embodiment stand for High and Low. In another embodiment, the switch 128 comprises two, three, four, five, or more exclusively selectable pushbuttons. In yet another embodiment the switch is a rotary switch including two, three, four, five, or more positions. In a further embodiment, the switch 128 comprises a touch sensitive mechanism on the surface of the vaporization device 100 that allows selection of any of two, three, four, five, or more configurations by sliding a finger across the surface. In still further embodiments the switch 128 has other structure that provides for two, three, four, five, or more configurations.

In an embodiment, the protruding slide portion of the switch 128 in a first configuration is disposed proximate to the L and away from the H. In a second configuration of the switch 128, the protruding slide portion is disposed proximate to the H and away from the L.

Figure 4A:
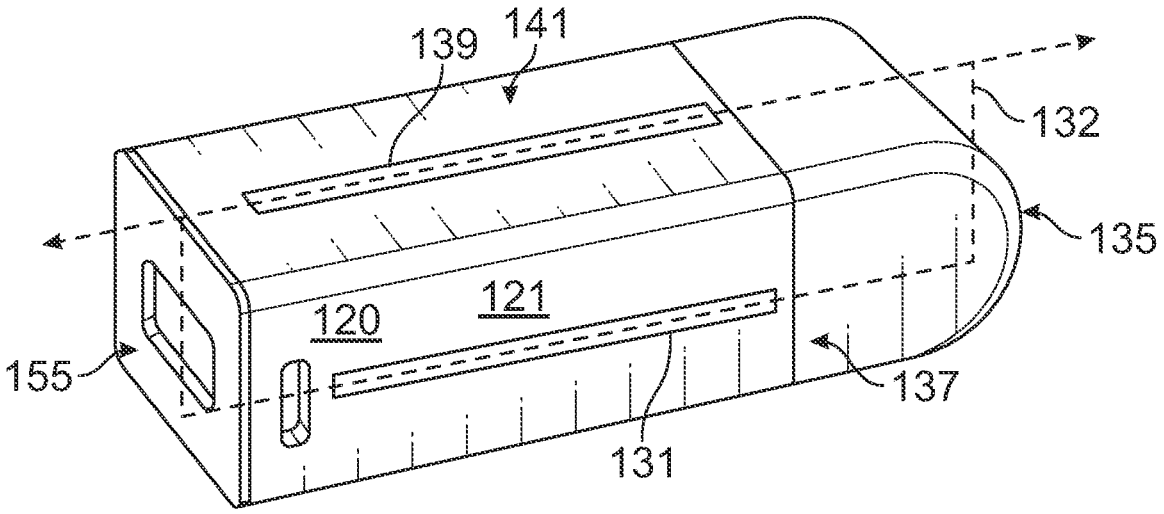
FIG. 4A shows a perspective side view of an exemplary substance cartridge/pod.
Figure 4B:
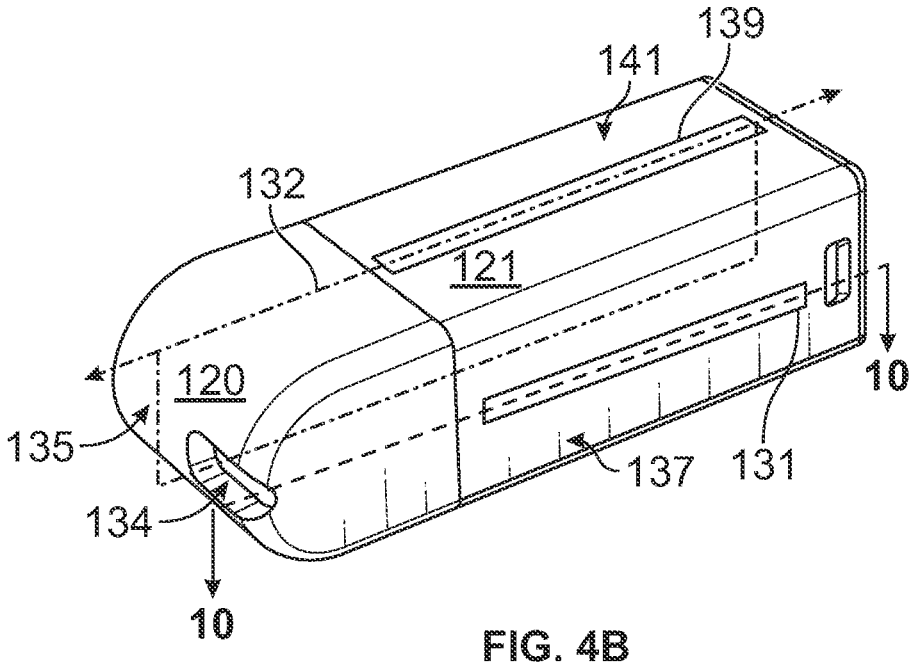
FIG. 4B shows a perspective side view of the exemplary substance cartridge/pod of FIG. 4A viewed from an opposite side.

As illustrated in FIGS. 4A and 4B, in an embodiment, each of the two or more identical substance cartridges/pods 120 includes a housing 121 having a first mating surface 155 at a first longitudinal end, a second longitudinal center plane 132 that is centered between lateral sides 137 (see also FIG. 8), and a vapor outlet hole 134 (see also FIGS. 5 and 6) disposed through a second surface 135 at a second longitudinal end of the housing 121. In an embodiment, the vapor outlet hole 134 is laterally offset from the second longitudinal center plane 132. In this context laterally offset indicates that a center of the vapor outlet hole 134 is laterally offset from the second longitudinal center plane 132. In an embodiment, the vapor outlet hole 134 is disposed at a corner of the cartridge/pod 120, meaning that the vapor outlet hole 134 extends to an edge of the second surface 135. The second surface 135 faces away from the body portion 110 when the cartridge/pod 120 is detachably attached to the body portion 110.

Figure 5:
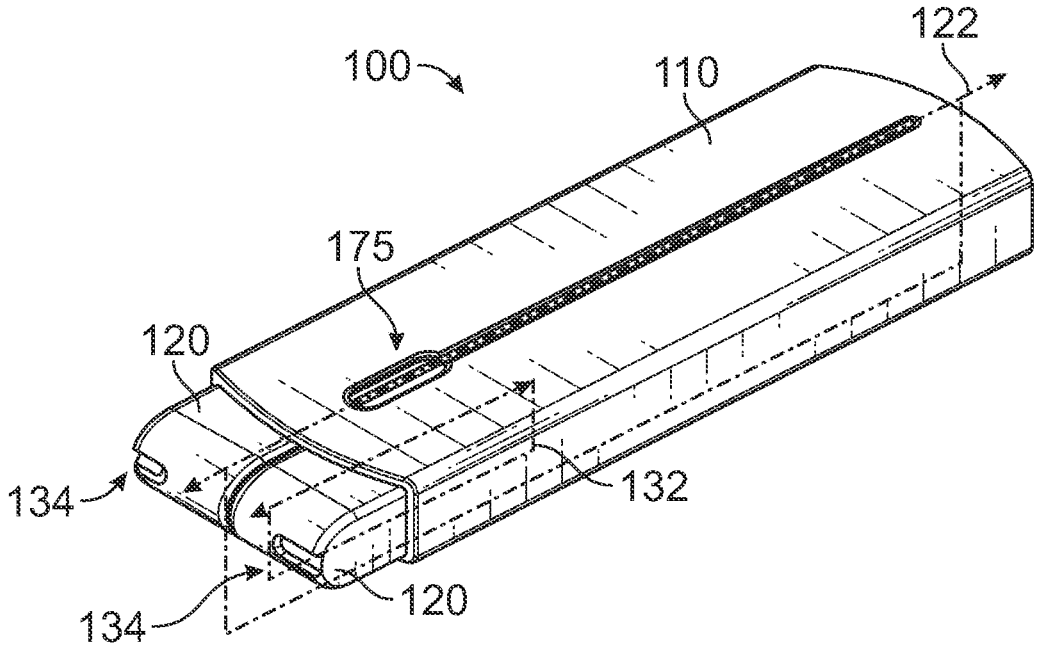
FIG. 5 shows an assembled configuration of an exemplary embodiment of a dual cartridge vaporization device.
Figure 6:
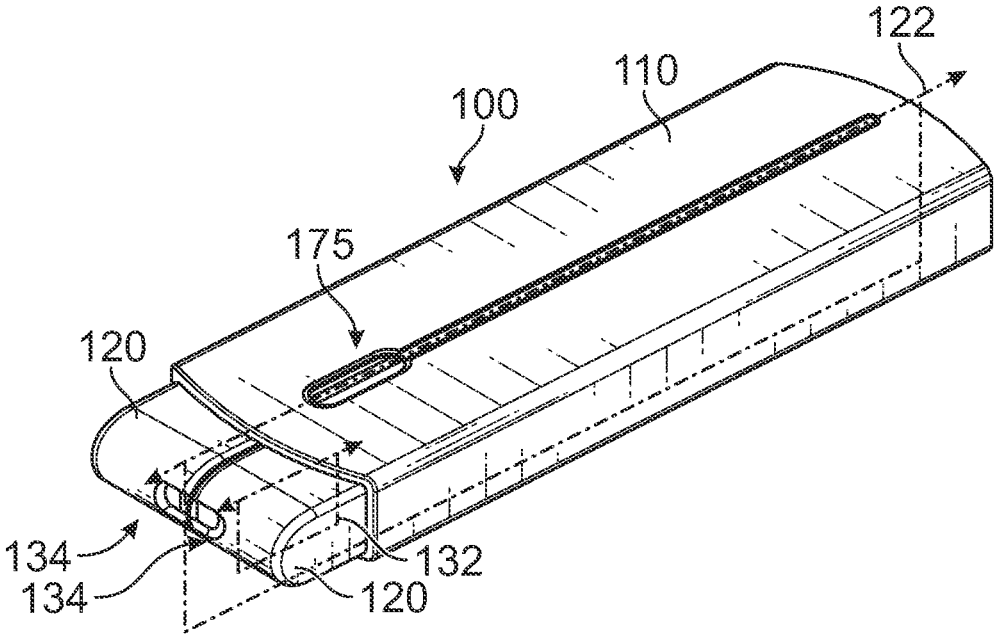
FIG. 6 shows another assembled configuration of an exemplary embodiment of a dual cartridge vaporization device.

Referring to FIGS. 5 and 6, each of the two or more identical substance cartridges/pods 120 is adapted to detachably attach to the body portion 110 in either of first or second orientations relative to the first longitudinal center plane 122. For example, in FIG. 5, both of the two or more identical substance cartridges/pods 120 are attached to the body portion 110 in a first orientation wherein the vapor outlet hole 134 is disposed on an opposite side of the second longitudinal center plane 132 from the first longitudinal center plane 122. Therefore, when a substance cartridge/pod 120 is detachably attached to the body portion 110 in the first orientation, the vapor outlet hole 134 is positioned at an outer corner of the vaporization device 100. In contrast to FIG. 5, in FIG. 6 both of the two or more identical substance cartridges/pods 120 are attached to the body portion 110 in a second orientation wherein the vapor outlet hole 134 is disposed between the second longitudinal center plane 132 and the first longitudinal center plane 122. Therefore, when a substance cartridge/pod 120 is detachably attached to the body portion 110 in the second orientation, the vapor outlet hole 134 is positioned proximate to the first longitudinal center plane 122 of the vaporization device 100.

Referring again to FIG. 5, the vaporization device 100 is illustrated assembled in a first configuration wherein the first and second cartridges/pods 120 of the two or more identical substance cartridges/pods 120 are both attached to the body portion 110 in the first orientation. Referring again to FIG. 6, the vaporization device 100 is illustrated assembled in a second configuration wherein the first and second cartridges/pods 120 of the two or more identical substance cartridges/pods 120 are both attached to the body portion 110 in the second orientation. Other configurations for the assembled vaporization device 100 are also possible, for example, a third configuration of the vaporization device 100 comprises a partial combination of the configurations illustrated in FIGS. 5 and 6, in particular, the third configuration comprises a first cartridge/pod 120 of the two or more identical substance cartridges/pods 120 attached to the body portion 110 in the first orientation and a second cartridge/pod 120 of the two or more identical substance cartridges/pods 120 attached to the body portion 110 in the second orientation.

Figure 7:
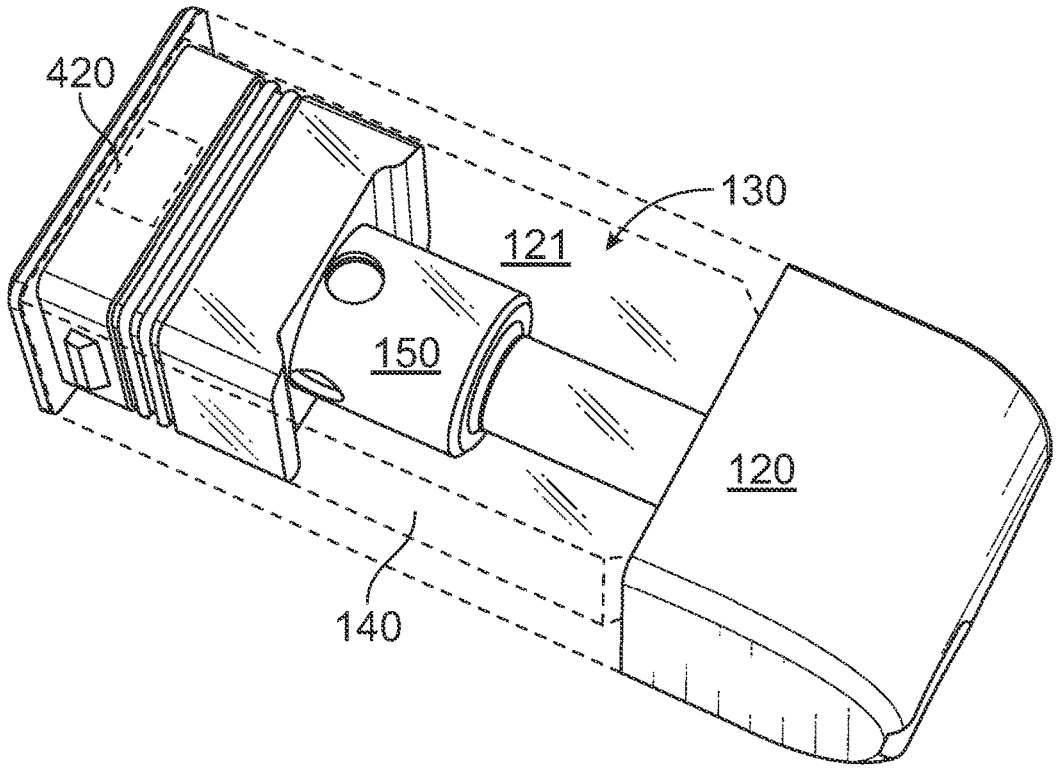
FIG. 7 shows an embodiment an exemplary substance cartridge/pod having at least a portion thereof that is transparent, which exposes internal components thereof.

Referring to FIG. 7, in an embodiment an exemplary substance cartridge/pod 120 is shown to have at least a portion of the housing 121 thereof that is transparent, which exposes internal components thereof. Other embodiments of the exemplary substance cartridge/pod 120 may or may not have a transparent portion without limitation. In an embodiment the substance cartridge/pod 120 comprises a reservoir 130 for holding a liquid comprised of *cannabis* oils and/or one or more electronic vaporization liquids (or e-liquids for short) 140 that comprise one or more active ingredients comprising, for example without limitation, *cannabis* oils, flavorings, cannabinoids, caffeine, nicotine, a botanical, a terpene or terpenes, or other plant materials, herbs or blends thereof. The fill level of the oils and e-liquids 140 within the reservoir 130 can be seen through the portion of the housing 121 of the substance cartridge/pod 120 that is transparent. The identical substance cartridges/pods 120 in an embodiment are factory filled and sealed and are not meant to be reopened after being filled and sealed. Preventing the identical substance cartridges/pods 120 from being reopened prevents a third party from filing them with uncertified formulations of the oils and e-liquids 140.

Each of the substance cartridges/pods 120 further includes a heating element 150 wherein the oils and e-liquids 140 are heated into a vapor. The structure and function of the heating element 150 is described in further detail hereinbelow. In an embodiment where the two or more identical substance cartridges/pods 120 are disposable, when the oils and e-liquids 140 within a substance cartridge/pod 120 are depleted the substance cartridge/pod 120 is simply discarded and replaced with another substance cartridge/pod 120.

Figure 8:
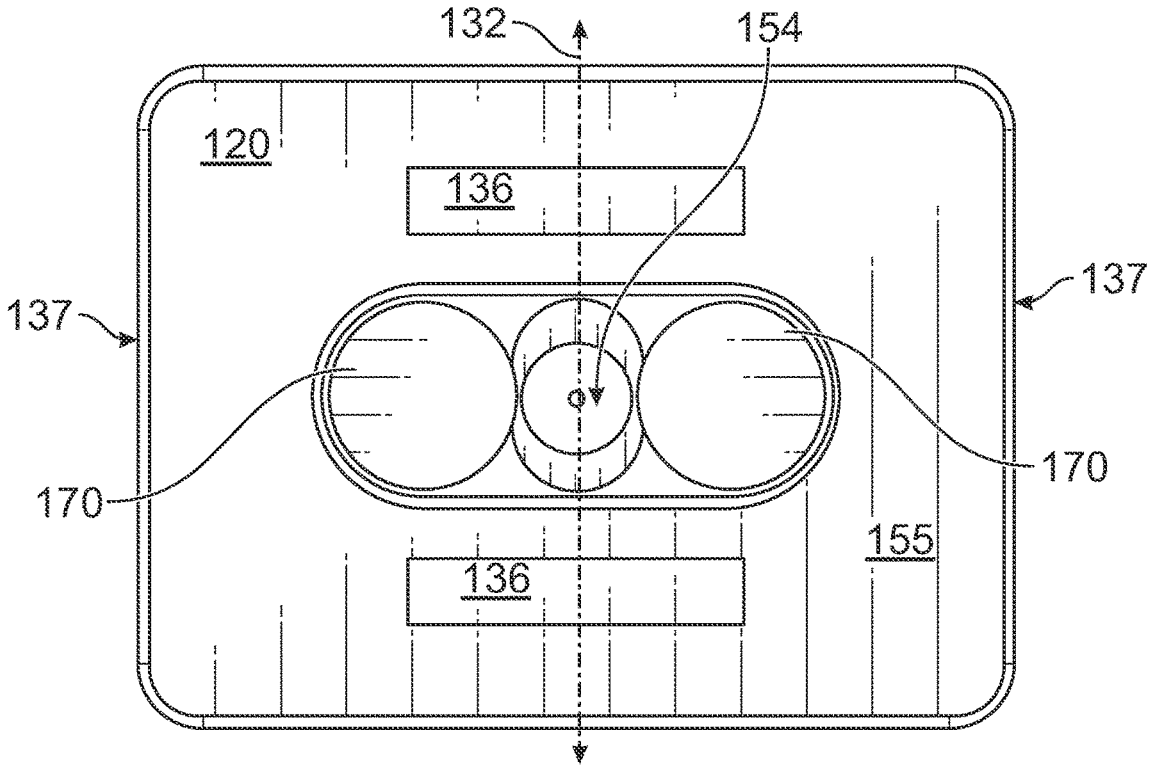
FIG. 8 shows a mating surface of an exemplary substance cartridge/pod.
Figure 9:
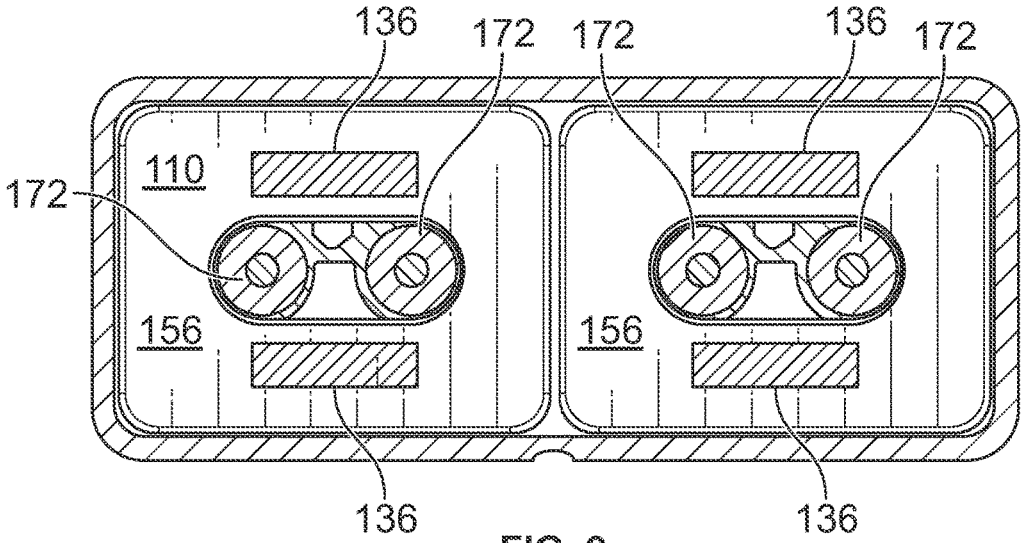
FIG. 9 shows a mating surface of an exemplary body portion.

The two or more substance identical cartridges/pods 120 detachably attach to the body portion 110 for example without limitation by a magnetic attachment, a snap fit, a press fit, or by any type of removable attachment as known in the art. FIGS. 8 and 9 illustrate mating surfaces 155, 156 of each identical cartridge/pod 120 and of the body portion 110, respectively. In an embodiment, for example, referring to the mating surfaces 155, 156 shown in FIGS. 8 and 9, each identical substance cartridge/pod 120 and/or the body portion 110 has a magnet or magnets 136 disposed within and/or exposed at the mating surface 155, 156 thereof. In embodiments having a magnet 136 on each mating surface 155, 156 the magnets 136 attach by mutual magnetic attraction. In embodiments having a magnet 136 in only one mating surface 155 or 156, the opposite mating surface 156 or 155 is a magnetic metal so that the magnet 136 attaches to the opposite mating surface 156 or 155.

Referring to FIG. 2B, an exemplary body portion 110 is shown from the first end 124 without the two or more detachably attached identical substance cartridges/pods 120, which allows a view looking into the body portion 110 exposing a portion of the second mating surface 156. In an embodiment, one or more inner surfaces 127 includes at least one longitudinally disposed groove or protrusion 129 on each side of the first longitudinal center plane 122.

In an embodiment, the longitudinally disposed grooves or protrusions 129 are positioned to engage with a complementary structure or structures on each of the two or more identical substance cartridges/pods 120. For example, in an embodiment, a complementary protrusion or groove 139 (see FIGS. 4A and 4B) is disposed at least partially along each top and bottom side 141, and/or, a complementary protrusion or groove 131 (see FIGS. 4A and 4B) is disposed at least partially along each lateral side 137, of each of the two or more identical substance cartridges/pods 120. In an embodiment, the longitudinally disposed grooves or protrusions 129 engage with the structures 139 and/or 141 to assist a user in guiding the two or more identical substance cartridges/pods 120 into proper position when inserting them into the body portion 110 for detachable attachment therewith. In an embodiment, engagement of the longitudinally disposed grooves or protrusions 129 with the structures 139 and/or 141 also assists in keeping each once inserted cartridge/pod 120 in a proper fixed position by decreasing the likelihood of the cartridge/pod 120 tilting or twisting or otherwise loosening relative to the inner surfaces 127 and/or the second mating surface 156.

Figure 10:
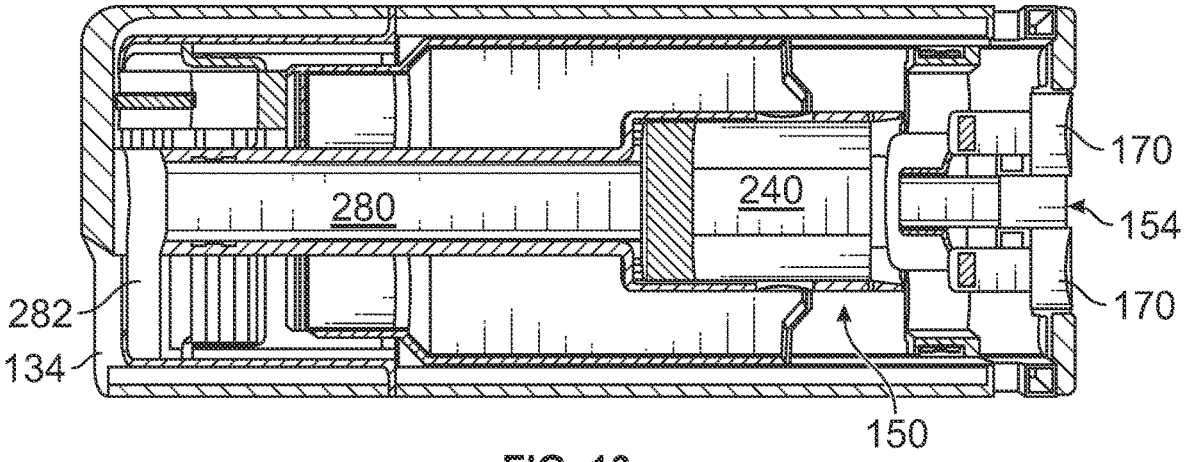
FIG. 10 shows a cross-sectional view of an exemplary cartridge/pod taken generally along the lines 10-10 as shown in FIG. 4B.

FIG. 10 illustrates a cross-sectional view of an exemplary cartridge/pod 120 taken generally along the lines 10-10 as shown in FIG. 4B. Referring to FIGS. 8 and 10, in an exemplary embodiment two or more electrically conductive elements 170, for example, electrical connectors 170, which in the embodiments shown in FIGS. 8 and 10 are also cathodes 170, are disposed at the first mating surface 155. Although only two electrical connectors 170 are shown in FIGS. 8 and 10 it should be understood that the number of electrical connectors 170 can be three, four, five, or more. The two or more electrical connectors 170 may be disposed at an end of the heating element 150 as visible in FIG. 10 or may be disposed at different portions of the first mating surface 155.

Figure 11:
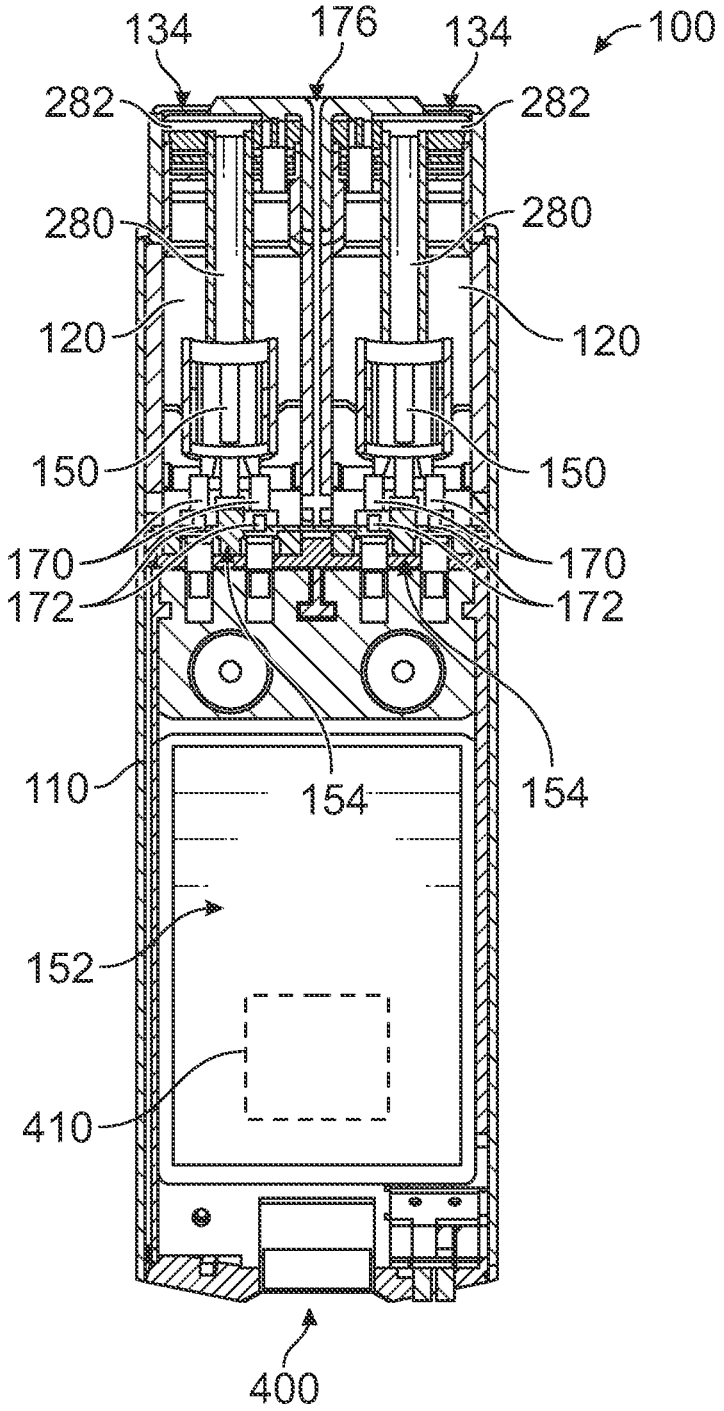
FIG. 11 shows a cross-sectional view of an exemplary assembled vaporization device taken generally along the lines 11-11 as shown in FIG. 3.

FIG. 11 illustrates a cross-sectional view of an exemplary assembled vaporization device 100 taken generally along the lines 11-11 as shown in FIG. 3. In an embodiment electrical power is supplied to the heating elements 150 (to one or more metal coils 260 within each heating element—see FIGS. 12 and 13) from the one or more batteries 152 housed in the body portion 110 via a pair of the two or more electrical connectors 170 that make contact with electrically conductive elements 172, for example, electrical terminals 172, which in the embodiments shown in FIGS. 8 and 10 are also anodes 172 on the body portion 110 through the mating surface 156. The body portion 110 includes such electrical terminals 172 for each individual substance cartridge/pod 120 with which it detachably attaches. Further, each of the individual substance cartridges/pods 120 can attach in either the first orientation or the second orientation with respect to the first longitudinal centerline 122.

In an embodiment one or more of the two or more electrical connectors 170 on each individual substance cartridge/pod 120 and/or one or more of the electrical terminals 172 on the body portion 110 are spring loaded to urge their connection when the substance cartridge/pod 120 is detachably attached into the housing of the body portion 110. In other embodiments none of the two or more electrical connectors 170 or the electrical terminals 172 are spring loaded. Further, the two or more electrical connectors 170 and the electrical terminals 172 may comprise any cross-sectional shape without limitation, for example circular as shown, or rectangular, or elliptical or any other shape as is known in the art.

Referring again to FIG. 8, it is important to note that all of the structures and features disposed on the first mating surface 155, for example, the magnet or magnets 136 and the electrical connectors 170 are laterally symmetrical across the second longitudinal center plane 132. In an embodiment wherein there is an arrangement of two or more magnets 136, the arrangement of the two or more magnets 136 is laterally symmetrical across the second longitudinal center plane 132. This lateral symmetry allows each of the two or more identical substance cartridges/pods 120 to be detachably attached in exactly the same way in the first and second orientations described hereinabove.

Referring to FIGS. 1, 2, 5, and 6 the body portion 110 includes a viewing portal 175 disposed through at least one sidewall, wherein the viewing portal 175 aligns with a transparent portion of each of the cartridges/pods 120 when the vaporization device 100 is assembled. This alignment allows a user to visually check the fill level of oils and e-liquids 140 remaining in the reservoir 130 of each of the cartridges/pods 120. The opening of the viewing portal 175 also provides fluid communication between an exterior of the vaporization device 100 and an interior of the body portion 110.

Referring to 11, when a user pulls a drag on a substance cartridge/pod 120, air flows from the exterior of the vaporization device 100, through the heating element 150 of the substance cartridge/pod 120. Referring to FIGS. 8 and 10, in an embodiment, the air enters the heating element 150 through an air passage 154 disposed through the mating surface 155 of the substance cartridge/pod 120. In an embodiment, the air flows from the exterior of the vaporization device 100 to the air passage 154 through a path provided at least by the viewing portal 175 and a space 176 between the substance cartridges/pods 120 within an interior of the body portion 110. In an embodiment, when each of the two or more identical substance cartridges/pods 120 is detachably attached, sufficient space remains between the first and second mating surfaces 155, 156 for air to flow from the interior of the body portion 110 into the air passage 154.

Because the vaporization device 100 includes two or more substance cartridges/pods 120 each having an independent heating element 150 and an independent reservoir 130 holding oils and e-liquids 140, a user may choose between using one or more of the substance cartridges/pods 120 individually or collectively. This choice for mode of use is further facilitated by multiple assembled configurations described hereinabove for the vaporization device 100. For example, in a vaporization device 100 assembled in the first configuration as shown in FIG. 5, the positioning of the outlet vapor holes 134 at outer corners of the vaporization device 100 makes it easy for a user to draw on only one of the substance cartridges/pods 120 at a time. In contrast, in a vaporization device 100 assembled in the second configuration as shown in FIG. 6, the positioning of the outlet vapor holes 134 proximate to the center plane 122 of the vaporization device 100 makes it easy for a user to draw on both of the substance cartridges/pods 120 at the same time.

Figure 12:
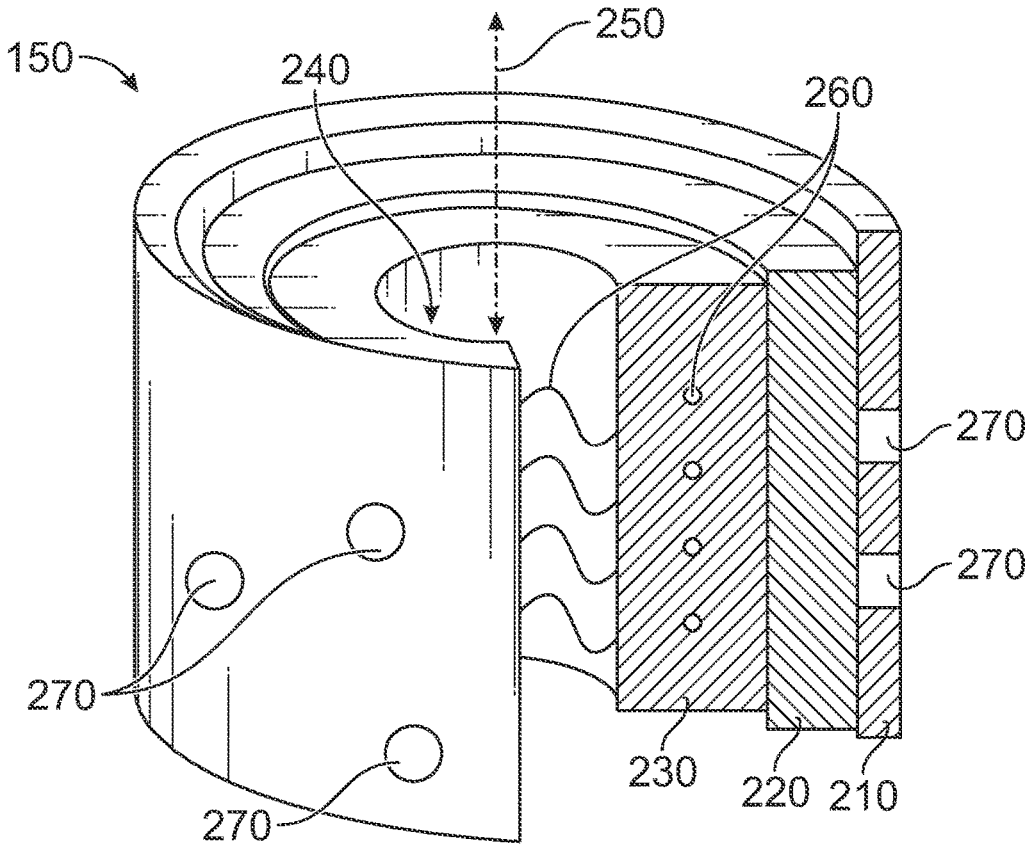
FIG. 12 shows an isolated partial cross-sectional view of an exemplary embodiment of a heating element.

Referring to FIG. 12, an exemplary embodiment of the heating element 150 is illustrated in an isolated partial cross-sectional view that reveals structure across the radius of the heating element 150. In this embodiment the heating element 150 has a generally cylindrical shape with a circular cross-section; however, in other embodiments the heating element 150 has a cross-section that is triangular or rectangular or pentagonal or hexagonal or any closed regular or irregular polygon without limitation.

Starting with the outermost radial portion of the heating element 150, in an embodiment an outer casing 210 radially surrounds a layer of absorptive material 220, for example without limitation, cotton, silica, ceramic, rayon, stainless steel, hemp, or other wick materials as are known in the art. The layer of absorptive material 220 in an embodiment radially surrounds a porous ceramic base 230. In this embodiment the porous ceramic base 230 happens to be cylindrical; however, in other embodiments the porous ceramic base 230 can have any cross-sectional shape as described hereinabove. In an embodiment the porous ceramic base 230 has a central passage 240 disposed along a longitudinal axis 250 thereof. In an embodiment, one or more metal coils 260 are embedded inside the ceramic base 230, for example near to or along the surface of the central passage 240 as illustrated in FIG. 12. In another embodiment, also included in FIG. 12, the one or more metal coils 260 are embedded further inside the ceramic base 230 so that they are not visible from the central passage 240.

Either or both of the layer of absorptive material 220 and the outer casing 210 may extend over one or both ends of the porous ceramic base 230. In an embodiment except for air passages into the central passage 240 as described more fully hereinbelow, the heating element 150 is sealed on the top and bottom ends either by the same material of the outer casing 210, by the material of the reservoir 130, or otherwise and by other material as may be known in the art.

In operation in an embodiment, oils and e-liquids 140 from the reservoir 130 penetrate the outer casing 210 and is absorbed into and saturates the layer of absorptive material 220. The oils and e-liquids 140 are further absorbed from the saturated layer of absorptive material 220 into the porous ceramic base 230. Upon activation (as will be described hereinbelow), power is applied to the metal coils 260 thereby heating them. The heated metal coils 260 in turn heat the ceramic base 230 to a sufficient temperature to vaporize the oils and e-liquids 140 that have been absorbed into the porous ceramic base 230. Vaporized oils and e-liquids 140 expand out from the porous ceramic base 230 into the central passage 240 where it mixes with air from outside the device for ultimate inhalation by the user. In an embodiment the layer of absorptive material 220 also provides a layer of padding or cushioning against breakage of the porous ceramic base 230, which may be brittle. For example, if the vaporization device 100 is thrown or dropped or otherwise subjected to a violent physical shock, the layer of absorptive material 220 adds protections against cracking or breakage of the porous ceramic base.

The oils and e-liquids 140 penetrate the outer casing 210 in one of several ways depending on the embodiment. In one embodiment, the outer casing 210 is made from a material that is porous to the oils and e-liquids 140, for example a porous ceramic like that of the ceramic base 230, or other porous material as known in the art and suitable for such purpose. In another embodiment, the outer casing 210 has one or more apertures disposed radially through it. For example, referring to FIG. 12, the outer casing 210 may have one or more apertures 270 that provide communication between the reservoir 130 and the layer of absorptive material 220. The one or more apertures 270 may be spaced regularly or irregularly and arranged in a pattern horizontally around the outer casing 210, vertically along the outer casing 210, both horizontally and vertically, or randomly in no particular pattern around the outer casing 210. In yet another embodiment the outer casing 210 may be porous to the oils and e-liquids 140 and also have one or more of the apertures 270 as described above.

Upon penetrating the outer casing 210, the oils and e-liquids 140 are vaporized by the heat of the ceramic base 230 and pass into the central passage 240 for mixing with air as described hereinabove. Any of the oils and e-liquids 140 reaching the metal coils 260 before being vaporized by the heat of the ceramic base 230 is vaporized by the heat of the metal coils 260. When the heated coils are not powered on the oils and e-liquids 140 that penetrate into the ceramic base 230 do not exit the ceramic base 230 into the central passage 240. Without being held to a particular theory, the oils and e-liquids 140 are believed to be held within the ceramic base 230 by the porosity of the central base 230, which tends to draw the oils and e-liquids 140 into it and which also prevents the oils and e-liquids 140 from flowing out of it.

Referring to FIGS. 10 and 11, air and vaporized oils and e-liquids 140 exit the heating element 150 through pipe 280 that extends from an outlet side of the heating element 150. Pipe 280 may be made from a metal or a ceramic or may be the same material as the outer casing 210. As fully explained in U.S. Provisional Application 63/033,659, which the current application claims priority to, upon application of vacuum to the vapor outlet hole 134, for example by a user's draw, a vacuum caused by the draw is sensed by a sensor that is disposed somewhere within the path of air that enters the heating element 150 and exits through the vapor outlet hole 134. The sensor can be any type of sensor that can detect the flow of air or the drop in pressure associated with the flow of air, for example without limitation, a pressure sensor, an airflow sensor, or other sensors as are known in the art. Still referring to FIGS. 10 and 11, the pipe 280 extends away from the heating element 150 and toward the vapor outlet hole 134. In an embodiment, the pipe 280 fluidly communicates with the vapor outlet hole 134 through a connecting plenum 282.

Regardless of where the sensor is disposed within the vaporization device 100, the sensor has an electrical connection to internal control circuitry 340 that is further electrically connected to the one or more batteries 152 in the body portion 110 and also to the metal coils 260. For example, as shown schematically in FIG. 13, a circuit board 342 disposed within the housing of the body portion 110 includes the internal control circuitry 340 disposed thereon. In another embodiment the internal control circuitry 340 is disposed within the substance cartridge/pod 120.

Referring to FIG. 13, the switch 128 and the indicator light 131 are also electrically connected within the internal control circuitry 340. In an embodiment, the internal control circuitry 340 further includes at least two voltage regulator modules 133, one for each of the two or more cartridges/pods 120. Because a user may draw on each of the cartridges/pods 120 individually, a voltage regulator module 133 is electrically connected between the one or more batteries 152 and each of the two or more identical substance cartridges/pods 120.

The at least two voltage regulator modules 133 are configured to output one of at least two distinct voltages, wherein which distinct voltage is output depends upon the configuration of the switch 128 that is electrically connected to the at least two voltage regulator modules 133. As described hereinabove, the switch 128 has at two, three, four, five, or more configurations. Therefore, the at least two voltage regulator modules in any embodiment will have at least as many distinct voltage outputs as the number of configuration for the switch 128. For example, when the switch 128 is in a first configuration the voltage regulator modules 133 output a first distinct voltage, when the switch 128 is in a second configuration the voltage regulator modules 133 output a second distinct voltage, when the switch 128 is in a third configuration the voltage regulator modules 133 output a third distinct voltage, when the switch 128 is in a fourth configuration the voltage regulator modules 133 output a fourth distinct voltage, when the switch 128 is in a fifth configuration the voltage regulator modules 133 output a fifth distinct voltage, and so forth. In an embodiment, the first voltage is about 2.6 volts and the second voltage is about 3.5 volts. Other embodiments include more than two electable distinct voltages having values that are the same or other than 2.6 and 3.5 volts.

A selectable voltage output as described hereinabove allows a user to further enhance their vaping experience as desired. For example, in the first configuration of the switch 128, the protruding slide portion is disposed proximate to the L and away from the H, which would cause the voltage regulator module to output a voltage of about 2.6 volts, which in this example is a relatively Low voltage. Without being held to any particular theory, it has been found that when the heating element 150 is supplied with the Low voltage of about 2.6 volts, the vapor produced by the heating element 150 is relatively more flavorful by having more preserved *cannabis* terpenes and/or oils and/or e-liquid 140 flavorings. However, when the switch 128 is in the second configuration and the protruding slide portion is disposed proximate to the H and away from the L, and the heating element 150 is supplied with the High voltage of about 3.5 volts. The vapor produced by the heating element 150 with the switch 128 in the second configuration is relatively more potent taking advantage of the particular substances in the oils and e-liquids 140, for example without limitation, CBD, THC and/or other cannabinoids, nicotine, caffeine, or chamomile.

In summary of use, when a user pulls a draw on a vapor outlet hole 134, the sensor senses the associated vacuum or pressure drop and/or the air flow associated with the draw. The internal control circuitry 340 is triggered by the sensor 330 to apply power from the one or more batteries 152 in the body portion 110 to the metal coils 260, which heat up to heat the ceramic base 230 and vaporize the oils and e-liquids 140 that have been drawn into pores of the ceramic base 230 by capillary action from the layer of absorptive material 220. The vaporized oils and e-liquids 140 pass out of the ceramic base 230 into the central passage 240 and out of the heating element 150 through the pipe 280, which fluidly communicates with the vapor outlet hole 134 through the connecting plenum 282.

In an embodiment, the one or more batteries 152 have a power capacity of about 450 mAh. In an embodiment the one or more batteries 152 include a USB-C adapter that provides for universal charging cord adaptability. For example, as illustrated in FIGS. 3, 11, and 13, the one or more batteries 152 have a USB-C port 400 on an edge thereof. The USB-C port may be either a male or a female port both as known in the art. The USB-C port 400 in other embodiments can be located on a different surface of the one or more batteries 152 than is illustrated in FIGS. 3, 11, and 13. Regardless of the location of the USB-C port 400 the port connects with the one or more batteries 152 directly, via the internal control circuitry 340, or via other dedicated USB port circuitry within the body portion 110 to allow charging of the one or more batteries 152 via the USB-C port 400 as is known in the art.

In some embodiments the vaporization device 100 further includes a feature for recognition of substance cartridges/pods 120 that are genuine and provided by the vaporization device 100 manufacturer for appropriate use within the function of the vaporization device 100. For example, referring to FIGS. 11 and 13, in one embodiment the battery portion is equipped with an RFID reader 410, which is powered by the one or more batteries 152 and in electrical communication with or actually part of the internal control circuitry 340. The RFID reader 410 can read the information on an RFID tag as is known in the art. For example, the substance cartridge/pod 120 illustrated in FIG. 7 includes an RFID tag 420 disposed therein.

In an embodiment, the RFID tag 420 is disposed in a portion of the substance cartridge/pod 120 that is separate and sealed from the reservoir 130. The RFID tag 420 can be positioned on the substance cartridge/pod 120 as shown or in any position and/or orientation as desired that is suitable for being read by the RFID reader 410. In some embodiments the RFID tag 420 is a passive tag having no on-board power source as is known in the art. Instead the RFID tag 420 receives power from the RFID reader 410 when being read thereby. In other embodiments the RFID tag 420 is an active tag and draws power from the one or more batteries when the substance cartridge/pod 120 is attached to the battery portion 110. In one embodiment wherein the RFID tag 420 requires physical contact with the RFID reader 410 to be read, the RFID tag 420 is positioned on the substance cartridge/pod 120 to make physical contact with the RFID reader 410 when the substance cartridge/pod 120 is attached to the battery portion 110. The RFID tag 420 is programmed as is known in the art to include information that is particular to or recognizable by the RFID reader 410.

When a substance cartridge/pod 120 having such a programmed RFID tag 420 is connected with a battery portion 110 having the RFID reader 410, information programmed onto the RFID tag 420 is read by the RFID reader 410. If the information read from the RFID tag 420 matches with information stored in the RFID reader 420, the substance cartridge/pod 120 is considered to be recognized by the RFID reader 410, and the vaporization device 100 is allowed by the internal control circuitry 340 as informed by a recognition signal from the RFID reader 410 to operate as described hereinabove with the recognized substance cartridge/pod 120. However, if the information read from the RFID tag 420 does not match with information stored in the RFID reader 410, or if a cartridge/pod is inserted into the battery portion 110 without an RFID tag 410 on it, then the inserted cartridge/pod is not recognized by the RFID reader 410, and no recognition is sent from the RFID reader 410 to the internal control circuitry 340. Without a recognition signal from the RFID reader 410, the internal control circuitry 340 will not allow power to be supplied the heating element 150 (or any sensor), which effectively prevents the vaporization device 100 from functioning with the unrecognized cartridge/pod 120. By requiring a recognition signal to be passed from the RFID reader 410 to the internal control circuitry 340, the use of substance cartridges/pods 120 that are not provided by the vaporization device 100 manufacturer for use within the function of the vaporization device 100 is therefore prevented.

Referring again to FIG. 3, in an embodiment, the second end 126 of the body portion 110 includes four small protuberances or bumps 143, which allow the vaporization device 100 to be supported on a surface by the protuberances 143. Supporting the vaporization device 100 on the protuberances 143 allows it to be stored with each of the attached identical substance cartridges/pods 120 facing upwardly away from the surface so that the vaporization device 100 appears to be standing up vertically on the protuberances 143.

INDUSTRIAL APPLICABILITY

A dual cartridge vaporization device comprises one or more batteries disposed in a body portion having a first longitudinal center plane and two or more identical substance cartridges each adapted to detachably attach to the body portion in first and second orientations relative to the first longitudinal center plane. In an embodiment a voltage regulator electrically connected between the one or more batteries and each of the two or more identical substance cartridges is configured to output two distinct voltages. The dual cartridge vaporization device can be manufactured in industry for use by consumers.

Numerous modifications to the present invention will be apparent to those skilled in the art in view of the foregoing description. It is not desired to limit the invention to the exact construction and operation shown and described, and accordingly, all suitable modifications and equivalents may be resorted to, falling within the scope of the invention. Accordingly, this description is to be construed as illustrative only of the principles of the invention and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

The invention claimed is:

1. A vaporization device, comprising:

one or more batteries disposed in a body portion having a first longitudinal center plane; and two or more identical substance cartridges each adapted to detachably attach to the body portion in first and second orientations relative to the first longitudinal center plane; wherein each of the two or more identical substance cartridges comprises:

a housing having first and second longitudinal ends and a second longitudinal center plane that extends between the first and second longitudinal ends; and a vapor outlet hole disposed through a surface at the first longitudinal end, wherein the vapor outlet hole is laterally offset from the second longitudinal center plane.

2. The vaporization device of claim 1, wherein the two or more identical substance cartridges are disposable.

3. The vaporization device of claim 1, wherein the first orientation for each cartridge comprises attachment with the vapor outlet hole disposed on an opposite side of the second longitudinal center plane from the first longitudinal center plane, and the second orientation for each cartridge comprises attachment with the vapor outlet hole disposed between the second longitudinal center plane and the first longitudinal center plane.

4. The vaporization device of claim 3, wherein a first configuration of the vaporization device comprises first and second cartridges of the two or more identical substance cartridges both attached to the body portion in the first orientation.

5. The vaporization device of claim 3, wherein a second configuration of the vaporization device comprises first and second cartridges of the two or more identical substance cartridges both attached to the body portion in the second orientation.

6. The vaporization device of claim 3, wherein a third configuration of the vaporization device comprises a first cartridge of the two or more identical substance cartridges attached to the body portion in the first orientation and a second cartridge of the two or more identical substance cartridges attached to the body portion in the second orientation.

7. The vaporization device of claim 1, further comprising a magnet disposed in one or both of the body portion and the two or more identical substance cartridges, so that the two or more identical substance cartridges magnetically attach to the body portion.

8. The vaporization device of claim 1, further comprising a voltage regulator electrically connected between the one or more batteries and each of the two or more identical substance cartridges, wherein the voltage regulators are configured to output at least two distinct voltages.

9. The vaporization device of claim 8, further comprising a switch electrically connected to the voltage regulators, wherein the switch has at least first and second configurations, and wherein when the switch is in the first configuration the voltage regulators output a first of the at least two distinct voltages, and wherein when the switch is in the second configuration the voltage regulators output a second of the at least two distinct voltages.

10. A vaporization device, comprising:

one or more batteries disposed in a body portion;

two or more identical substance cartridges each adapted to detachably attach to the body portion; and a voltage regulator electrically connected between the one or more batteries and each of the two or more identical substance cartridges, wherein the voltage regulators are configured to output at least two distinct voltages.

11. The vaporization device of claim 10, further comprising a switch electrically connected to the voltage regulators, wherein the switch has at least first and second configurations, and wherein when the switch is in the first configuration the voltage regulators output a first of the at least two distinct voltages, and wherein when the switch is in the second configuration the voltage regulators output a second of the at least two distinct voltages.

12. The vaporization device of claim 11, wherein the first distinct voltage is about 2.6 volts and the second distinct voltage is about 3.5 volts.

13. The vaporization device of claim 10, wherein the body portion comprises a longitudinal center plane and the two or more identical substance cartridges are each adapted to detachably attach to the body portion in first and second orientations relative to the longitudinal center plane.

14. The vaporization device of claim 13, further comprising a magnet disposed in one or both of the body portion and the two or more identical substance cartridges, so that the two or more identical substance cartridges magnetically attach to the body portion.

15. A substance cartridge for a vaporization device, comprising:

a housing having first and second longitudinal ends and a longitudinal center plane that extends between the first and second longitudinal ends;

a first mating surface at the first longitudinal end, wherein the first mating surface includes electrical connections that are laterally symmetrical across the longitudinal center plane; and a vapor outlet hole disposed through a second surface at the second longitudinal end, wherein the vapor outlet hole is laterally offset from the longitudinal center plane.

16. The substance cartridge of claim 15, wherein the vapor outlet hole extends to an edge of the second surface.

17. The substance cartridge of claim 15, wherein the substance cartridge is disposable and at least a portion of the housing is transparent.

18. The substance cartridge of claim 15, wherein at least one magnet is disposed on the first mating surface, and the at least one magnet is laterally symmetrical across the longitudinal center plane.

19. The substance cartridge of claim 15, wherein the at least one magnet comprises an arrangement of two or more magnets, and wherein the arrangement of the two or more magnets is laterally symmetrical across the longitudinal center plane.

* * * * *